United States Patent [19]

Stryker et al.

[11] Patent Number: 5,069,465

[45] Date of Patent: Dec. 3, 1991

[54] DUAL POSITION PUSH HANDLES FOR HOSPITAL STRETCHER

[75] Inventors: Martin W. Stryker, Kalamazoo Township, Kalamazoo County; Thomas W. Fennell, Portage, both of Mich.

[73] Assignee: Stryker Corporation, Kalamazoo, Mich.

[21] Appl. No.: 662,382

[22] Filed: Feb. 26, 1991

Related U.S. Application Data

[63] Continuation-in-part of Ser. No. 470,851, Jan. 26, 1990, abandoned.

[51] Int. Cl.[5] ..... A61G 1/02

[52] U.S. Cl. ..... 280/47.371; 5/82 R; 296/20; 403/102

[58] Field of Search ..... 280/47.371, 47.315, 280/655.1, 655, 640; 296/20; 5/82; 403/102, 101, 100, 97; 16/112

[56] References Cited

U.S. PATENT DOCUMENTS 1,639,801 8/1927 Heise ..... 296/20

3,004,768 10/1961 Klages ..... 280/47.315

FOREIGN PATENT DOCUMENTS 0672557 5/1952 United Kingdom ..... 280/47.371

OTHER PUBLICATIONS

Midmark 530 Stretcher Information, Midmark Catalog, p. 14.

*Primary Examiner*—David M. Mitchell

*Attorney, Agent, or Firm*—Flynn, Thiel, Boutell & Tanis

[57] ABSTRACT

A stretcher for a medical patient has at one end two L-shaped handles which each have first and second legs and which are each supported at the outer end of the first leg for 90° pivotal movement between a position in which the first leg is horizontal and approximately level with the top surface of the stretcher and a position in which the second leg is horizontal and located vertically higher than the top surface of the stretcher. The stretcher has two spaced vertical openings therein, and the first leg of each handle has an extension, each extension being received in a respective opening in the stretcher for lengthwise sliding movement between a first position in which the extension is disposed substantially within the opening and a second position in which the extension is disposed substantially outside the opening. When the handle is in its second position, it can be pivoted with respect to the opening from its second position to a third position about an axis extending transversely of the opening, the handle being in its two positions when the extension is respectively in its first and third positions.

23 Claims, 4 Drawing Sheets

DUAL POSITION PUSH HANDLES FOR HOSPITAL STRETCHER

This application is a continuation-in-part of U.S. Ser. No. 07/470,851, filed Jan. 26, 1990 and now abandoned.

FIELD OF THE INVENTION

This invention relates to a mobile stretcher for a medical patient and, more particularly, to an improved handle arrangement provided at one end of the stretcher to facilitate manual maneuvering of the stretcher.

BACKGROUND OF THE INVENTION

Mobile stretchers are frequently used in hospitals to move patients from place to place, which means that hospital personnel must manually maneuver the stretcher. It is desirable that a single person be able to manually maneuver the stretcher with ease, and preferably from one end of the stretcher in order to make it easy for stretchers to pass within the relatively narrow halls of some hospitals. In this regard, it is customary for the person to be at the end of the stretcher which corresponds to the head of the patient, but this also raises a problem with respect to the provision of a handle, because when the stretcher is stationary medical personnel working on the patient may need to have full access to the head of the patient without restriction of any handle.

One traditional approach is not to provide any handle at all at the end of the stretcher. Stretchers typically have collapsible side rails, and when the side rails are in a raised position a person at the end of the bed can lean forward and grasp the ends of the side rails and use them to maneuver the stretcher. However, maneuvering the stretcher while leaning over in this manner is a common source of serious back injuries in hospitals. Alternatively, the person can grasp the end of the bed frame, but it is usually difficult to obtain a secure grasp on the bed frame, and the person must usually lean over in order to reach the bed frame, which presents the same risk of injury just mentioned. A further consideration is that, when the person maneuvering the stretcher leans over the head of the patient, one or both may breathe on the other, thereby increasing the risk that the person maneuvering the stretcher receives from the patient an infectious disease for which the patient is being treated or gives to the patient a common infectious disease such as a cold.

To avoid leaning over when grasping the bed frame, it is possible to use the conventional mechanism in most stretchers which permits the height of the mattress to be adjusted. However, this increases the height of the patient above the floor and thus presents a greater danger to the patient, as well as giving the patient a reduced sense of security. Still another approach with such a bed, without raising the height of the bed, is to push on a piece of auxiliary equipment such as a vertical pole provided at an end of the bed to support an intravenous apparatus, but auxiliary equipment is usually not designed to take the forces required to move and control a stretcher.

A handle has been previously developed for the end of a stretcher, and can be moved between a position in which it is at a height above the mattress and convenient for manually maneuvering the stretcher, and a position in which it is retracted beneath the bed frame of the stretcher. However, this known handle is relatively large and heavy, and increases the weight of the bed. Further, it is relatively cumbersome to operate, because the person operating it must step back from the end of the bed in order to swing the handle from its operative position to its retracted position. Moreover, when the handle is in its retracted position it cannot reasonably be used as a handle, it can hit the knees of persons attempting to work on the patient, and because of its size it can prevent the bed frame from being vertically dropped as low as might be desirable in some cases.

Accordingly, an object of the present invention is to provide a handle arrangement for facilitating manual maneuvering of a vehicle such as a stretcher, in which the handle is movable between two positions which each permit it to be used as a handle, one of the positions permitting the stretcher to be easily manually maneuvered with minimal opportunity for back injury.

A further object of the invention is to provide a handle, as aforesaid, which does not restrict vertical movement of the bed frame in either of its positions.

Yet another object of the invention is provide a handle, as aforesaid, which is compact and can be quickly and easily moved between its two positions.

A further object of the invention is to provide a handle, as aforesaid, which is simple and inexpensive to manufacture, and which is durable and requires no maintenance.

SUMMARY OF THE INVENTION

The objects and purposes of the invention, including those set forth above, are met according to one form of the present invention by providing on a vehicle a handle arrangement which includes a handle supported for movement between first and second positions, wherein in the first position the handle provides at a first vertical level a portion which can be manually gripped, and in the second position provides at a second vertical level different from the first vertical level a portion which can be manually gripped.

According to a different feature of the invention, a movably supported vehicle has a handle provided at one end thereof and has an arrangement for facilitating movement of the handle between two positions, such arrangement including an elongate opening provided in one of the vehicle and handle and an extension provided on the other thereof, the extension being received within the opening for lengthwise sliding movement between a first position in which the extension is disposed substantially within the opening and a second position in which the extension is disposed substantially outside the opening. The extension is pivotal with respect to the opening from its second position to a third position about an axis extending transversely of the opening, the handle being in its two positions when the extension is respectively in its first and third positions.

BRIEF DESCRIPTION OF THE DRAWINGS

A preferred embodiment of the present invention will be described in detail hereinafter with reference to the accompanying drawings, in which.

DETAILED DESCRIPTION

Figure 1:
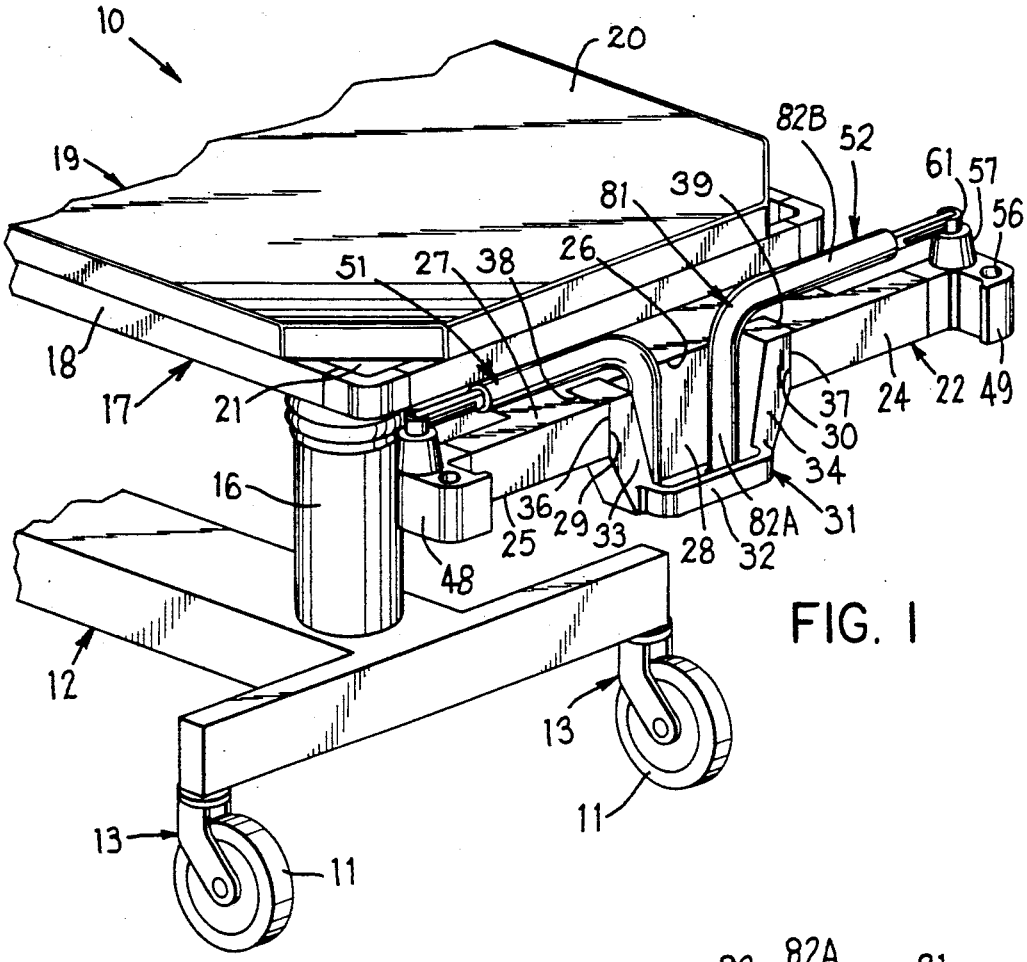
FIG. 1 is a fragmentary perspective view of an end of a stretcher embodying the present invention.

Referring to FIG. 1, a vehicle 10 is movably supported by wheels 11 and is a mobile hospital bed or stretcher. The bed 10 includes an I-shaped base 12 which is supported by four caster assemblies 13, each of which includes one of the wheels 11, and only two of which are visible in FIG. 1.

Two vertical pedestals 16, only one of which is visible in FIG. 1, are secured to and extend upwardly from the base 12, and a metal frame assembly 17 is supported on the tops of the pedestals 16. The frame assembly 17 includes a rectangular frame 18 having an upwardly facing top surface 21. A mattress 19 is supported on the upwardly facing surface 21 of the frame 18, and the mattress 19 has an upwardly facing top surface 20. The pedestals 16 are preferably conventional fluid operated cylinders which can vary the vertical position of and inclination of the frame assembly 17 and mattress 19 in a conventional manner, but could also be rigid columns which non-movably support each end of the frame assembly 17 and mattress 19 at a constant vertical height.

The base 12, caster assemblies 13, pedestals 16, frame 18 and mattress 20 are all conventional, and are therefore not described here in further detail.

Figure 2:
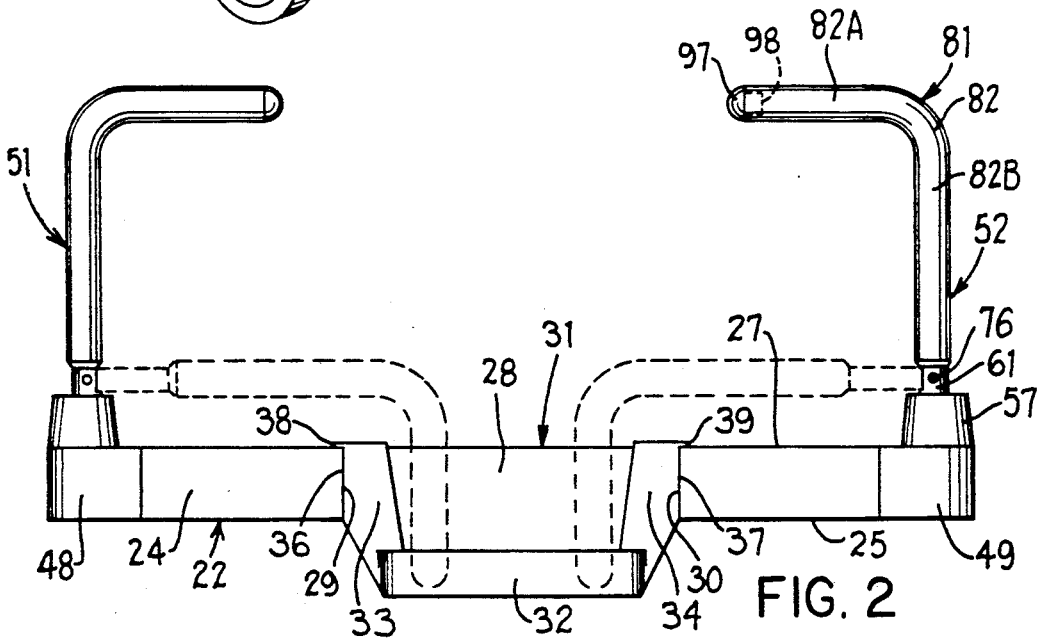
FIG. 2 is an elevational end view of a portion of the stretcher of FIG. 1, showing two handles in operational positions different from FIG. 1.

Referring to FIGS. 1 and 2, the frame assembly 17 includes a metal support 22 which is fixedly secured to and disposed below the frame 18, and which extends outwardly beyond one end of the frame 18. The support 22 has an outwardly facing vertical end surface 24 at the outer end thereof. A rectangular recess 26 opens into the center of the support 22 from the end surface 24, and extends vertically through the support 22 from a top surface 27 of the support 22 to a bottom surface 25 of the support 22. The recess 26 has an inner surface 28 which is parallel to the end surface 24 of support 22, and has end surfaces 29 and 30 which are perpendicular to and extend between the inner surface 28 of recess 26 and the end surface 24 of support 22. The support 22 preferably includes a portion which is located at the bottom inner edge of the recess 26, which projects downwardly below the bottom surface 25, and which has thereon a portion of the surface 28, so that the surface 28 extends downwardly to a location below the bottom surface 25 of the support 22.

Figure 6:
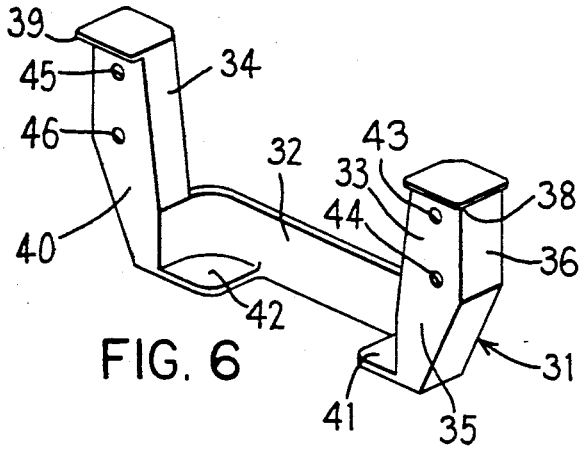
FIG. 6 is a perspective view of a handle rest which is a component of the stretcher of FIG. 1.

Still referring to FIGS. 1 and 2, a metal handle rest 31 is disposed in the recess 26, and is shown separately in FIG. 6. The handle rest 31, as evident from FIG. 6, is approximately U-shaped, and includes a bight 32 and two legs 33 and 34 which extend upwardly from opposite end portions of the bight 32. The bight 32 is a vertically extending wall, and has curved end portions which extend outwardly from the lower ends of the legs 33 and 34 and has an approximately straight central portion connecting the curved end portions.

The legs 33 and 34 have respective back surfaces 35 and 40, which are each disposed against the inner surface 28 of the recess 26 in support 22, and the legs each have a respective side surface 36 or 37 which is disposed against a respective one of the end surfaces 29 or 30 of the recess 26. The leg 33 has at the upper end thereof a flange 38 which extends outwardly in two directions, namely rearwardly beyond the surface 35 and sidewardly beyond the surface 36, and the leg 34 has a similar flange 39. The undersides of the flanges 38 and 39 are disposed against the top surface 27 of the support 22. The leg 33 has two threaded holes 43 and 44 which open into it from the back surface 35, and the leg 34 has two similar holes 45 and 46. Four conventional screws or bolts, which are not visible in the drawings, have threaded shanks which extend through not-illustrated holes in the support 22 and into the threaded holes 43–46 in the handle rest 31, in order to fixedly secure the handle rest 31 to the support 22. It will be recognized that the handle rest 31 could be fixedly secured to the support 22 in other ways, for example through the use of an appropriate adhesive substance, or alternatively the handle rest 31 could be an integral part of the support 22.

The handle rest 31 also includes two flanges 41 and 42 which extend horizontally toward each other from the lower ends of the legs 33 and 34, and which each have an edge portion fixedly secured to the lower edge of the bight 32 in the region of a respective curved end portion of the bight 32. In the preferred embodiment, a layer of rubber or the like is adhesively secured to the top surface of each of the flanges 41 and 42, but the rubber layer is not essential.

As shown in FIG. 1, metal castings 48 and 49 are secured to respective lateral ends of the support 22. In the preferred embodiment, each casting has a not-illustrated projection of rectangular cross-section which extends into and is fixedly secured in a not-illustrated opening of rectangular cross-section in the support 22. However, other forms of connection are possible, and the castings 48 and 49 could even be integral parts of the support 22. Each casting supports a respective one of two handle assemblies 51 and 52. The casting 48 and handle assembly 51 are mirror images of, but otherwise identical to, the casting 49 and handle assembly 52, and therefore only the casting 49 and handle assembly 52 will be described in detail.

As shown in FIG. 1, the casting 49 has a vertical hole 56 extending through it. The hole 56 is provided to support different types of auxiliary equipment which are not pertinent to the present invention and are therefore not illustrated. For example, a not-illustrated elongate support could have a lower end inserted into the hole 56 and could have at an upper end a hook from which an intravenous apparatus could be hung.

Figure 3:
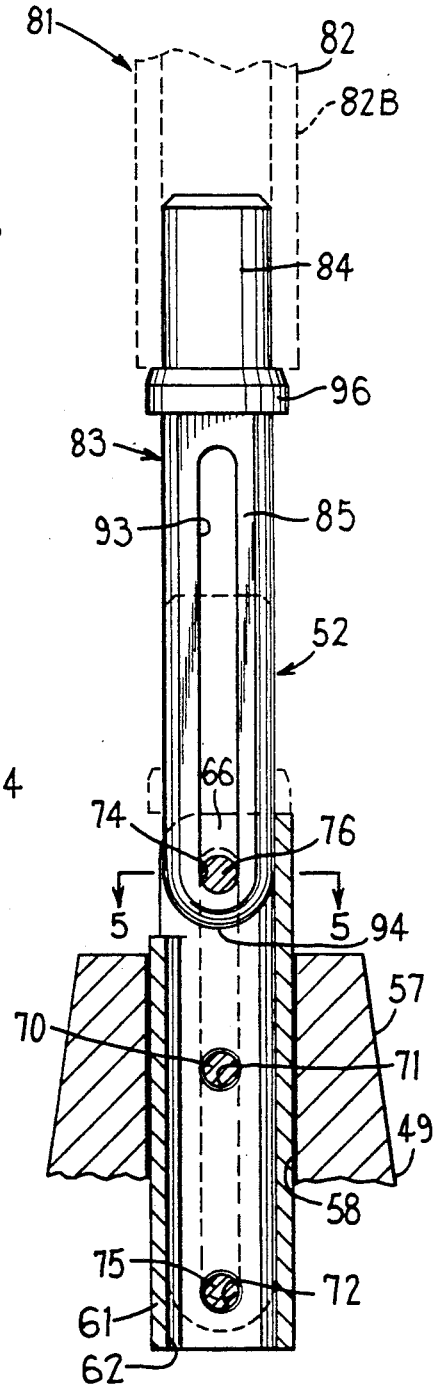
FIG. 3 is a fragmentary sectional view of a mechanism which facilitates pivotal movement of the handles depicted in FIG. 1.

The casting 49 also has an upwardly extending frustoconical projection 57, and extending centrally through the frustoconical projection and through the rest of the casting 49 is a cylindrical vertical hole 58 (FIG. 3).

Figure 5:
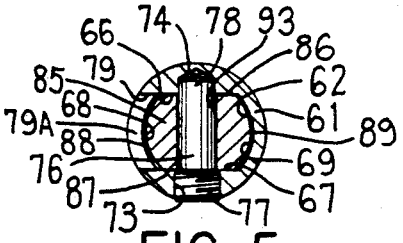
FIG. 5 is a sectional view taken along the line V—V in FIG. 3.

As shown in FIGS. 1, 3 and 5, the handle assembly 52 includes a metal sleeve 61 which has a cylindrical outer surface and which is disposed within the vertical cylindrical hole 58 through the projection 57 and casting 49. The outside diameter of the sleeve 61 is preferably only slightly smaller than the inside diameter of the cylindrical hole 58. The sleeve 61 has through it a central opening 62 which, as evident from FIG. 5, has a cross sectional shape which is approximately an oval, and which is sometimes referred to as a double-D shape. In particular, the opening 62 is defined by two spaced facing flat surfaces 66 and 67 which are parallel, and two arcuate end surfaces 68 and 69 which are concentric with respect to the cylindrical outer surface of the sleeve 61.

The sleeve 61 has, approximately midway along its vertical length, a threaded hole 71 which extends through diametrically opposite wall portions of the sleeve 71 approximately perpendicular to the surfaces 66 and 67. Near the lower end of the sleeve 61 is a threaded hole 72 which also extends through diametrically opposite wall portions substantially perpendicular to the flat surfaces 66 and 67. As shown in FIGS. 3 and 5, the sleeve 61 has near an upper end a blind hole 74 which extends from the flat surface 66 into the material of the sleeve 61, and has in a diametrically opposite wall portion and coaxially aligned with the blind hole 74 a threaded hole 73 which extends from the flat surface 67 completely through the wall of the sleeve. A cylindrical pin 76 has a threaded end 77 which threadedly engages the threaded hole 73, and a non-threaded end which is disposed in the blind hole 74, so that the pin 76 extends transversely across the central opening 62 through the sleeve 61.

The sleeve 61 has at its upper end a slot 79 which extends axially downwardly from the upper end of the sleeve 61 and has its lower end at 79A. At the upper end of the sleeve 61, the flat surfaces 66 and 67 of the central opening 62 extend leftwardly in FIGS. 3 and 5 all the way to the outer surface of the sleeve 61 so as to define the parallel opposite sides of the slot 79. The upper end of the sleeve 61 is rounded at 80 on the sides of the slot 79 in order to avoid a sharp point which could injure a person's hand. As shown in FIG. 3, the lower end 79A of the slot 79 is positioned a small distance above the top of the frustoconical projection 57. The sleeve 61 is fixedly secured in casting 49 by two bolts which each extend through a respective not-illustrated hole in the casting 49 and have a threaded tip 70 or 75 (FIG. 3) which threadedly engages one of the threaded openings 71 and 72 in the sleeve 61. The tips 70 and 75 of the bolts do not extend beyond the flat surface 66 or 67, and thus do not project at all into the central opening 62 through the sleeve 61.

As shown in FIG. 2, the handle assembly 52 includes an L-shaped handle 81. The handle 81 includes a cylindrical metal tube 82 which is bent to an L-shape so that it has respective legs 82A and 82B extending at right angles to each other. As shown in FIG. 3, the handle 81 also includes a metal part 83 having at its upper end a cylindrical pin 84 which extends into the leg 82B of tube 82 and which has an outside diameter substantially equal to the inside diameter of the end of the leg 82B of tube 82. The pin 84 is fixedly welded to the tube 82.

The part 83 has, extending outwardly beyond the end of the tube 82, an extension 85 which extends into and is cross sectionally congruent with the central opening 62 through the sleeve 61. In particular, as shown in FIG. 5, the extension 85 has flat side surfaces 86 and 87 which respectively slidably engage the flat surfaces 66 and 67 of opening 62, and the extension 85 has arcuate surfaces 88 and 89 which can respectively slidably engage the arcuate surfaces 68 and 69 of opening 62. These congruent cross sectional shapes prevent rotation of the part 83 relative to sleeve 61 about a vertical axis.

The extension 85 has an elongate slot 93 which extends lengthwise of the extension 85 and opens through each of the flat surfaces 86 and 87 provided on opposite sides of the extension. The pin 76 is slidably received in the slot 93, engagement of the pin 76 with opposite ends of the slot 93 limiting vertical sliding movement of the extension 85 (and thus handle 81) relative to the sleeve 61 to positions which are respectively shown in solid and broken lines in FIG. 3. The cooperation of the pin 76 and slot 93 also tends to prevent rotation of the part 83 relative to sleeve 61 about a vertical axis.

Figure 4:
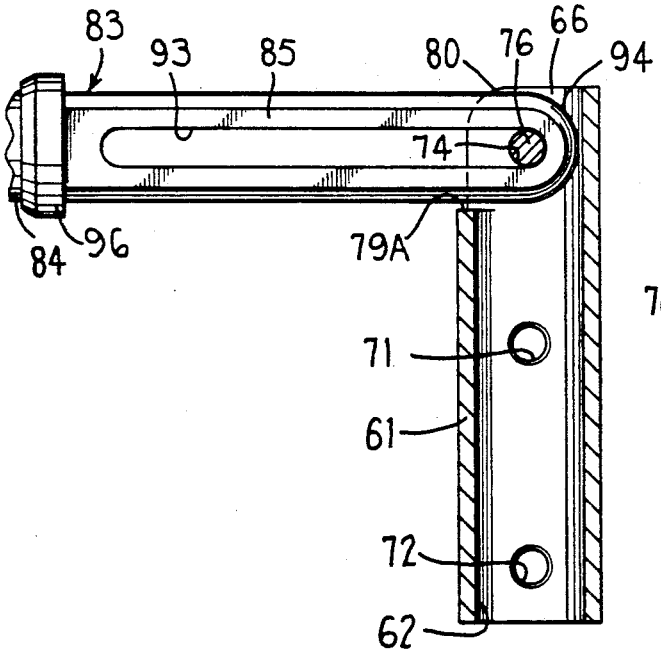
FIG. 4 is a fragmentary sectional view similar to FIG. 3 but showing a different operational position of the mechanism.

The lower end of the extension 85 has an approximately semicylindrical end surface 94 which is substantially concentric to the pin 76 when the pin 76 is at the end of slot 93 remote from pin 84, which permits the part 83 (and thus handle 81) to pivot 90° when the pin 76 is at this end of the slot 93 from the position shown in FIG. 3 to the position shown in FIGS. 1 and 4, in which latter position the extension 85 extends outwardly through the slot 79 in the wall of sleeve 61.

An annular collar portion 96 encircles the part 83 at the junction of the pin 84 and extension 85, and which engages the end of leg 82B of tube 82. The collar 96 is preferably integral with the part 83, but could be a separate metal component which is fixedly secured to the part 83 in any convenient and conventional manner. When the extension 85 is slid downwardly into the sleeve 61 to the position shown in broken lines in FIG. 3, the collar 96 engages the upper end of the sleeve 61, as also shown in broken lines in FIG. 3.

Referring to FIG. 2, the handle 81 also includes a rounded end cap 97 having a cylindrical projection 98 which is force fit in the outer end of leg 82A of tube 82. In the preferred embodiment, the tube 82 and end cap 97 have a fluidized bed coating of nylon which is baked on, in order to provide an improved appearance and a comfortable surface for manual gripping.

ALTERNATIVE EMBODIMENT

FIGS. 7 through 12 show a mobile stretcher which includes an alternative embodiment of the dual position handles according to the present invention, only the pertinent portions of this stretcher 110 being depicted. The stretcher 110 includes a frame assembly 112, which in turn includes a generally rectangular metal frame 113 and two lengthwise metal beams 116 and 117 fixedly secured to the frame 113, for example by welding. The beam 116 is a metal tube of rectangular cross section.

Figure 7:
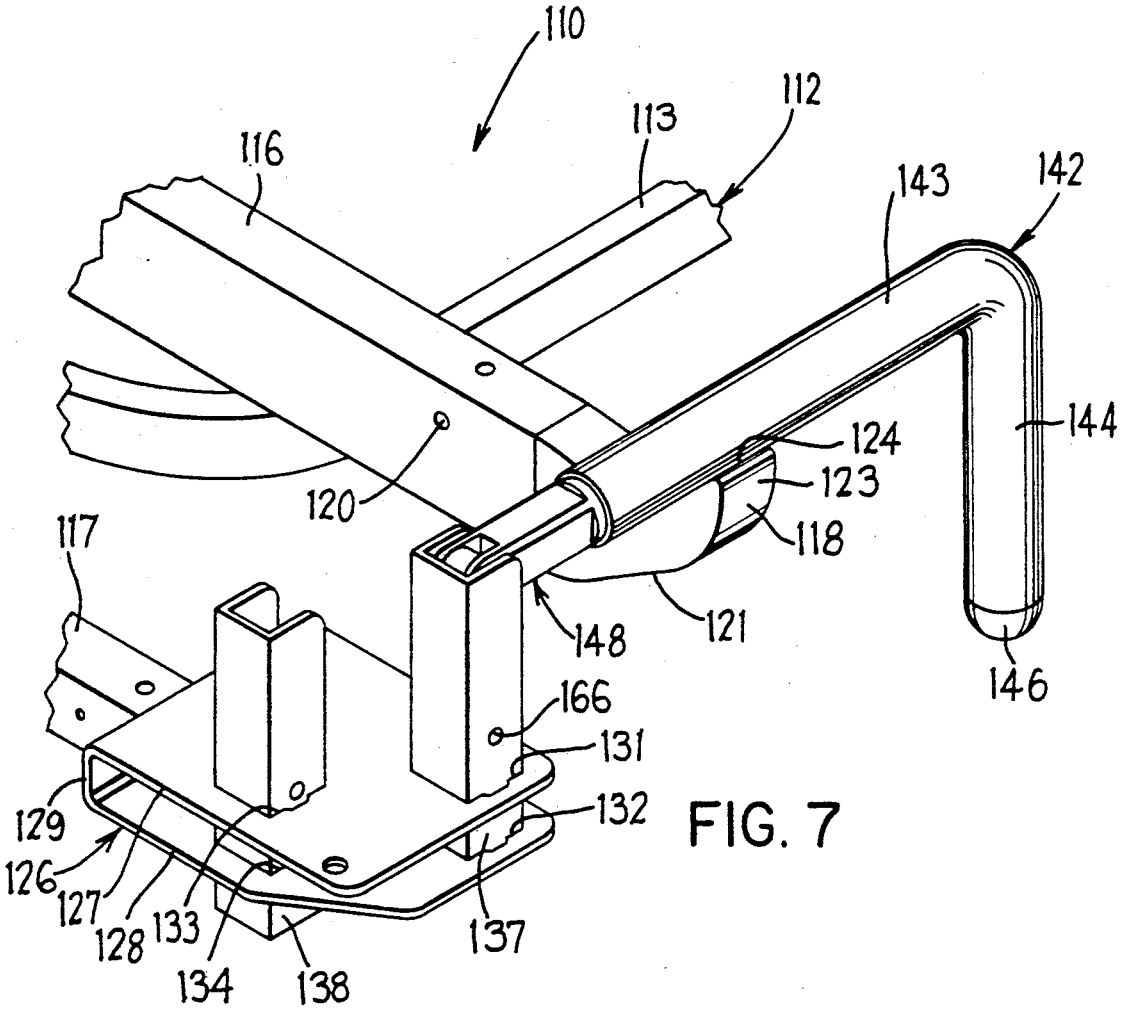
FIG. 7 is a fragmentary perspective view of an end portion of a stretcher which includes an alternative embodiment of the present invention.
Figure 12:
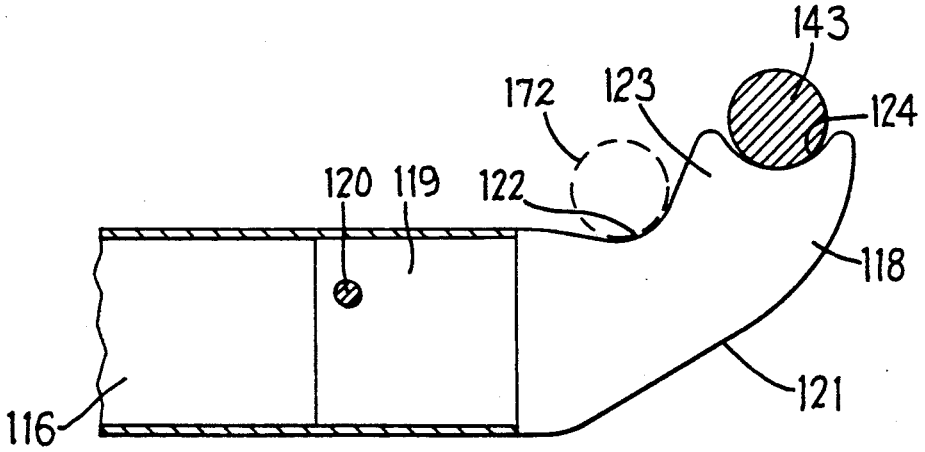
FIG. 12 is a fragmentary sectional side view of a portion of the stretcher of FIG. 7, including a handle support part.

As shown in FIGS. 7 and 12, a plastic support part 118 has a rectangular projection 119 which extends into the end of beam 116 and is secured in place by a pin 120 which extends through aligned openings in the beam 116 and the projection 119, the projection 119 having a rectangular cross sectional shape corresponding in size to the size of the opening through the beam 116. The support part 118 has on its underside a surface 121 which is inclined to extend upwardly and outwardly from the end of beam 116, and has on its upper side near the beam 116 a transversely extending shallow groove or recess 122. Just outwardly of the recess 122, the support part has an upward projection 123, and the upper end of the projection 123 having a shallow, upwardly facing, transversely extending groove or recess 124 of approximately semicylindrical shape.

A metal plate 126 is bent to a C-shape, so that it has a pair of horizontal parallel legs 127 and 128 connected by a vertical bight 129, the bight 129 being welded to the end of the metal beam 117. The plates 127 and 128 have respective aligned openings 131 and 132 of approximately square shape, and also have respective aligned openings 133 and 134 of approximately square shape, the openings 133 and 134 being offset from the openings 131 and 132 so as to be outwardly thereof in the transverse direction of the vehicle 110 and closer to the opposite end of the vehicle in the lengthwise direction thereof.

A sleeve 137 of square cross section has its lower end disposed in the aligned openings 131 and 132, and is fixedly secured to the legs 127 and 128 in an appropriate manner, for example by welding. An identical sleeve 138 is fixedly secured in a similar manner in the openings 133 and 134, except that the sleeve 138 is mounted slightly lower so that its lower end projects farther below the horizontal leg 128.

The vehicle 110 has at one end two L-shaped handle assemblies which are positioned and which function in a manner similar to the two handle assemblies 51 and 52 of FIG. 1, one of the handle assemblies being shown in FIG. 7 at 142. This handle assembly has a metal tube bent to a right angle so as to have legs 143 and 144, and has at an outer end of the leg 144 a plug 146, the plug 146 and the L-shaped tube being similar to the tube 82 and plug 97 shown in FIG. 2 for the previously-described embodiment.

Figure 10:
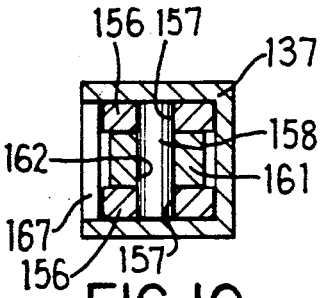
FIG. 10 is a sectional view taken along the line 10—10 in FIG. 9.
Figure 11:
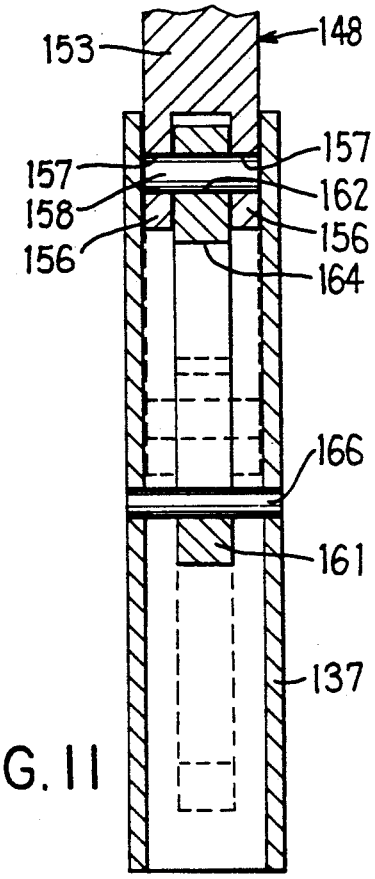
FIG. 11 is a sectional view taken along the line 11—11 in FIG. 9.
Figure 8:
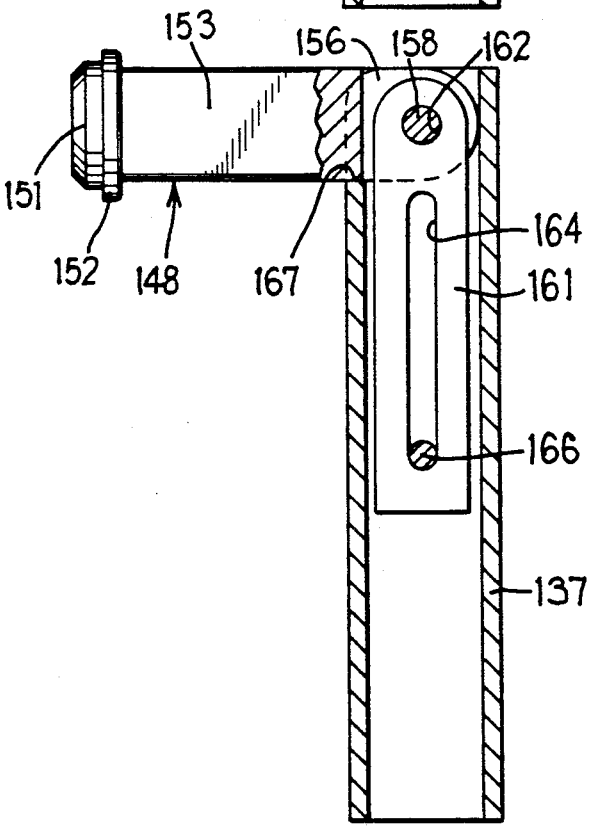
FIG. 8 is a fragmentary sectional side view of a mechanism which facilitates pivotal movement of a handle which is a component of the stretcher shown in FIG. 7.
Figure 9:
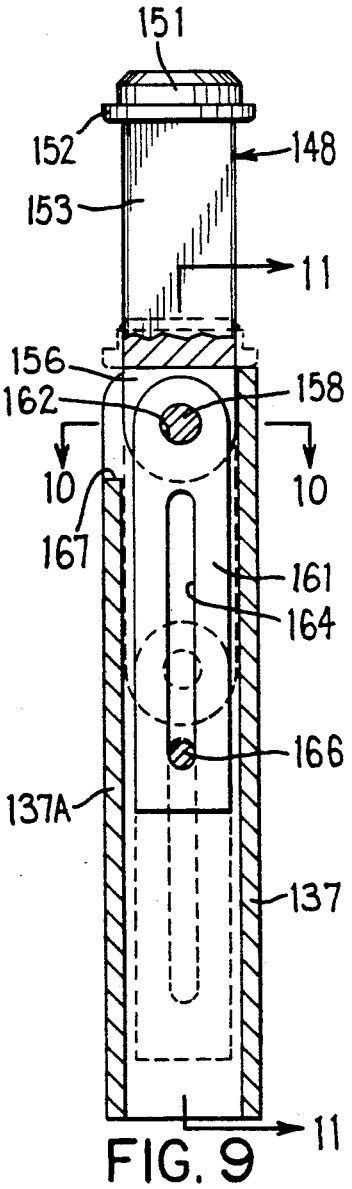
FIG. 9 is a fragmentary sectional view similar to FIG. 8 but showing a different operational position of the mechanism.

The handle assembly 142 includes at the outer end of the leg 143 a part 148, which will be described in more detail with reference to FIGS. 8–10. As shown in FIGS. 8 and 9, the part 148 has at one end a cylindrical stub 151, and has adjacent the stub 151 an annular flange 152. The stub 151 is received in the outer end of the tubular leg 143 of the handle 142, and the flange 152 is welded to the end of leg 143. Projecting outwardly from the flange 152 in an opposite direction from the stub 151 is an extension 153, the extension 153 having a square cross section of a size only slightly smaller than the square cross section of the vertical opening through the sleeve 137. The end of the extension 153 remote from the flange 152 has a pair of spaced, outwardly projecting flanges 156, as best seen in FIGS. 10 and 11. The flanges have aligned holes 157, and a pin 158 has its ends received in the aligned holes 157. Opposite walls of the sleeve 137 are adjacent the ends of the pin 158 and prevent it from moving in an axial direction. The outer ends of the flanges 156 are rounded generally concentrically to the pin 158.

A stop link 161 has its upper end disposed between the flanges 156 of the extension 153, and as shown in FIG. 10 the stop link has a rectangular cross section with a width approximately equal to the distance between the flanges 156. The pin 158 extends through a transverse opening 162 provided in the upper end of the stop link 161, and the upper end of the stop link 161 is rounded approximately concentrically to the pin 158. The part 148 can thus pivot relative to the stop link 161 about the pin 158. The stop link 161 also has a vertically extending slot 164 which opens transversely through it, and a stop pin 166 has its ends fixedly supported on opposite walls of the sleeve 137 approximately halfway along the length of the sleeve 137 and is slidably received in the slot 164.

As shown in FIGS. 9 and 10, the sleeve 137 has at the upper end of one wall 137A thereof a rectangular cutout 167 which is square and is of approximately the same size as the square cross section of the extension 153.

Referring to FIG. 7, the sleeve 138 is intended for use in movably supporting a conventional elongate intravenous pole (shown only at 172 in FIG. 12) in a manner similar to that in which the sleeve 137 movably supports the handle 142. When the intravenous pole supported by the sleeve 138 is lowered from an upright position to a storage position in which it extends horizontally, it is received in the recess 122 on the support part 118 as shown diagrammatically at 172 in FIG. 12. When the handle 142 is in the lowered position shown in FIG. 7, the recess 124 on the support part 118 receives the leg 143 of the handle 142 in order to support the handle 142, as shown in FIGS. 7 and 12, and so as to resist movement of leg 143 in directions lengthwise of the stretcher.

The C-shaped plate 126 and the middle portions of the sleeves 137 and 138 can be covered by a not-illustrated plastic shroud which has an external shape somewhat similar to that of the casting 48 shown in FIG. 1, only the upper ends of the sleeves 137 and 138 projecting above the shroud through openings therein.

OPERATION

Assume that the handle 81 is in the position shown in FIG. 2. In order to change the position of the handle, the handle is manually lifted straight upwardly so that, as shown in FIG. 3, the extension portion 85 slides upwardly within the sleeve 61 from the position shown in broken lines to the position shown in solid lines. Then, with the pin 76 at the end of the slot 93 remote from the pin 84, the handle 81 is pivoted about the pin 76 from the position shown in FIG. 3 to the position shown in FIGS. 1 and 4. In the position shown in FIG. 1, the end cap 97 (FIG. 2) of handle 81 is disposed against the rubber layer on the top surface of the flange 42 (FIG. 6) of the handle rest 31. As a practical matter, there may be a small amount of play between the extension 85 and sleeve 61 which permits the leg 82A of handle 81 to move between positions engaging the surface 28 on support 22 and the bight 32 of handle rest 31, but this is not essential. The handle 81 can be returned to its original position by pivoting it about the pin 76 from the position shown in FIGS. 1 and 4 to the position shown in FIG. 3, and then moving it vertically downwardly so that the extension 85 slides back into the sleeve 61 from the position shown in solid lines in FIG. 3 to the position shown in broken lines.

When the handle 81 is in the position shown in solid lines in FIG. 1 and broken lines in FIG. 2, the portion 82B extends horizontally and has its uppermost surface approximately level with the upper surface 20 of mattress 19 so that portion 82B is effectively below and does not project above the upper surface 20, whereas when the handle 81 is in the position shown in solid lines in FIG. 2 the portion 82A is approximately horizontal and is spaced above the top surface 20 of mattress 19.

When the handles of handle assemblies 51 and 52 are each in the position shown in solid lines in FIG. 2, an operator would normally manually grasp the horizontal portion of each handle (82A of handle 81) in order to manually maneuver the bed 10, but could also grasp the vertical portion of each handle (at 82B on handle 81), or could grasp the junction between the horizontal and vertical portions of each handle. Normally, the horizontal portion (at 82A on handle 81) will be most comfortable to grasp, because it is at a vertical level sufficient to permit the person to reach the handles without bending over. The handle portions 82A are colinear. When the handles are in the position shown in FIG. 1, the person would normally grasp a portion of each handle which is then horizontal (at 82B on handle 81) in order to manually maneuver the bed. In the position of the handles shown in FIG. 1, the portions 82B are colinear. It should be noted that the portion 82B of each handle is higher in the position shown in solid lines in FIG. 2 than the position shown in broken lines.

Turning to the alternative embodiment of the vehicle shown in FIG. 7, there are two of the handle assemblies 142 which are arranged symmetrically in a manner similar to the handle assemblies 51 and 52 in FIG. 1, only one of the handle assemblies 142 actually being illustrated in FIG. 7. When the handle assembly 142 is in the lowered position shown in FIG. 7, the part 148 and stop link 161 are in the positions shown in FIG. 8, in which the pin 166 is at the lower end of slot 164 in stop link 161, the upper end of the stop link 161 being slightly lower than the upper end of the sleeve 137, and the part 148 projecting horizontally outwardly through the cutout 167 in the sleeve 137. As in the embodiment of FIG. 1, the leg 143 is preferably a little lower than the upwardly facing support surface on the mattress of the stretcher when in the lowered position shown in FIG. 7.

In order to move the handle assembly 142 to its upright position, the handle is manually lifted so that the part 148 pivots 90° about the pin 158 from the position shown in FIG. 8 to the position shown in solid lines in FIG. 9. Then, the handle is manually lowered so that the stop link 161 and part 148 slid downwardly into the sleeve 137 until the position shown in broken lines is reached, in which the flange 152 engages the upper end of the sleeve 137, the pin 166 is near the upper end of the slot 164, and the lower end of the stop link 161 is spaced a small distance above the lower end of the sleeve 137. The handle assembly is moved from its upright position back to the lowered position of FIG. 7 by carrying out this sequence of movement in a reverse order.

Although a particular preferred embodiment of the invention has been disclosed in detail for illustrative purposes, it will be recognized that variations or modifications of the disclosed device, including the rearrangement of parts, lie within the scope of the present invention.

The embodiments of the invention in which an exclusive property or privilege is claimed are defined as follows:

1. An apparatus comprising a movably supported vehicle which is a stretcher for a medical patient and which has an upwardly facing support surface thereon, and handle means on said vehicle in the region of one end of said support surface for facilitating manual maneuvering of said vehicle, said handle means including a handle which is approximately L-shaped and has first and second legs which extend approximately at a right angle to each other, and including support means cooperable with an outer end of said first leg for supporting said handle on said vehicle for movement between first and second positions, wherein in said first position said first leg of said handle extends substantially horizontally at a first vertical level lower than said support surface on said vehicle and said second leg extends downwardly from an end of said first leg remote from said support means, and wherein in said second position said first leg of said handle extends approximately vertically upwardly and said second leg extends approximately horizontally outwardly from an upper end of said first leg at a second vertical level which is substantially vertically higher than said support surface on said vehicle.

2. An apparatus as recited in claim 1, wherein one of said handle and vehicle has means defining an elongate opening therein and the other thereof has an elongate extension which is received within said opening for lengthwise sliding movement between a first position in which said extension is disposed substantially within said opening and a second position in which said extension is substantially withdrawn from said opening, and means for facilitating pivotal movement of said extension with respect to said opening about an axis extending transversely of said opening from said second position to a third position in which said elongate extension extends approximately perpendicular to said elongate opening.

3. An apparatus as recited in claim 2, wherein said means facilitating pivotal movement includes said extension having therethrough an elongate slot which extends lengthwise thereof, and includes a pin which is coaxial with said pivot axis, which extends transversely across said opening at one end thereof, and which is slidably received in said slot in said extension.

4. An apparatus as recited in claim 3, wherein said opening and said extension have congruent non-circular cross sections.

5. An apparatus as recited in claim 4, wherein said opening and said extension each have a cross section which has parallel straight portions on opposite sides thereof and has arcuate end portions, said straight portions extending approximately perpendicular to said pivot pin.

6. An apparatus as recited in claim 5, wherein said vehicle includes a vertically extending sleeve fixedly supported thereon and having said opening extending vertically therethrough, said extension being provided on said handle.

7. An apparatus as recited in claim 6, wherein said pin has its ends supported in diametrically opposite wall portions of said sleeve in the region of an upper end of said sleeve, and wherein said sleeve has a slot which extends downwardly from said upper end thereof, said extension extending through said slot when said extension is in said third position with respect to said sleeve.

8. An apparatus as recited in claim 7, wherein said extension extends outwardly from an outer end of one said leg of said handle substantially parallel thereto.

9. An apparatus comprising a movably supported vehicle, a handle provided at an end of said vehicle, and means for facilitating movement of said handle between first and second positions, said handle including an elongate cylindrical metal tube which is bent to an L-shape so as to have first and second legs which are approximately perpendicular with respect to one another, including an end plug which has a first portion inserted in an outer end of said second leg and a second portion projecting outwardly beyond said outer end of said second leg, said second portion having a semispherical exterior surface thereon, and including an extension part welded to an outer end of said first leg and projecting outwardly therefrom, said means including an elongate vertical opening provided in said vehicle and including said extension part being received within said opening for lengthwise sliding movement between a first position in which the extension is disposed substantially within said opening and a second position in which the extension is disposed substantially outside said opening, said means including said extension part having therethrough an elongate slot which extends lengthwise thereof, and including a pin which extends transversely across said opening at one end thereof and which is slidably received in said slot in said extension, said pin facilitating pivotal movement of said extension part with respect to said opening from said second position to a third position about said pin, said handle being in its first and second positions when said extension is respectively in its first and third positions.

10. An apparatus as recited in claim 9, wherein said opening and said extension have congruent non-circular cross sections.

11. An apparatus as recited in claim 10, wherein said opening and said extension each have a cross section which has parallel straight portions on opposite sides thereof and has arcuate end portions, said straight portions extending approximately perpendicular to said pivot pin.

12. An apparatus as recited in claim 11, wherein said vehicle includes a vertically extending sleeve fixedly supported thereon and having said opening extending vertically therethrough; wherein said pin has its ends supported in diametrically opposite wall portions of said sleeve in the region of an upper end of said sleeve, and wherein said sleeve has a slot which extends downwardly from said upper end thereof, said extension extending through said slot when said extension is in said third position with respect to said sleeve.

13. An apparatus comprising a movably supported vehicle which is a stretcher for a medical patient and which has an upwardly facing support surface thereon, and handle means on said vehicle in the region of one end of said support surface for facilitating manual maneuvering of said vehicle, said handle means including first and second handles which are each approximately L-shaped and each have first and second legs which extend at approximately a right angle to each other, and including support means cooperable with an outer end of said first leg of each of said handles at respective first and second locations which are spaced from each other for supporting each of said handles on said vehicle for independent movement between first and second positions, wherein in said first position said first legs of said first and second handles are approximately colinear and extend approximately horizontally toward each other from said first and second locations at a first vertical level lower than said support surface on said vehicle and said second legs of said handles extend approximately downwardly from ends of said first legs which are adjacent, and wherein in said second position said first legs of said first and second handles extend approximately vertically upwardly from said first and second locations, respectively, and said second legs of said handles are approximately colinear and extend approximately horizontally toward each other from upper ends of said first legs at a second vertical level which is substantially vertically higher than said support surface on said vehicle.

14. An apparatus as recited in claim 13, including a handle rest provided on said vehicle between said first and second locations, wherein an outer end of said second leg of each said handle engages said handle rest when each said handle is in said first position.

15. An apparatus comprising a movably supported vehicle, a handle provided at an end of said vehicle, and means for facilitating movement of said handle between first and second positions, said means including an elongate and approximately vertical opening provided in said vehicle, an elongate link member vertically slidably supported in said opening for lengthwise movement between a first position and a second position above said first position, and an elongate extension which is provided on said handle and has an end pivotally coupled to an upper end of said link member, said extension being pivotal relative to said link member between a first position in which said extension is approximately colinear with said link member and a second position in which said extension extends at an angle to said link member, said extension moving into said opening as said link member moves from its second position to its first position while said extension remains pivotally oriented in its first position, said handle being in its first position when said extension and said link member are each in their first positions, and being in its second position when said extension and said link member are each in their second positions.

16. An apparatus as recited in claim 15, wherein said link member has therethrough an elongate slot which extends lengthwise thereof, and including a pin which extends transversely across said opening and is slidably received in said slot in said extension.

17. An apparatus as recited in claim 16, wherein said opening and said extension have congruent non-circular cross sections.

18. An apparatus as recited in claim 17, wherein said opening and said extension each have a substantially square cross section.

19. An apparatus as recited in claim 15, wherein said end of said extension has two spaced, outwardly projecting flanges, said upper end of said link member being disposed between said flanges, and including a pin which extends through aligned openings in said flanges and in said upper end of said link member.

20. An apparatus as recited in claim 15, wherein said vehicle includes a vertically extending sleeve which is fixedly supported thereon, has said opening extending vertically therethrough, and has in one side thereof at an upper end thereof a cutout, wherein said link member is disposed entirely within said sleeve in each of said first and second positions of said link member, and wherein when said extension and said link member are each in their second positions said upper end of said link member is near an upper end of said sleeve and said extension extends outwardly through said cutout.

21. An apparatus comprising: a movably supported vehicle having thereon a support part, said support part having an upwardly facing, transversely extending recess; an L-shaped handle having first and second legs which extend at approximately 90° with respect to each other, and means cooperable with an outer end of said first leg for supporting said handle for movement between a first position in which said first leg extends approximately vertically and said second leg extends approximately horizontally from an upper end of said first leg, and a second position in which said first leg extends approximately horizontally and said second leg extends approximately downwardly, wherein in said second position said support part engages said first leg at a location between the ends of said first leg and said first leg is received in said recess thereof.

22. An apparatus according to claim 21, wherein said vehicle includes a rectangular tubular member, and wherein said support part has thereon a projection of rectangular cross section which is received in an end of said tubular member, said support part extending outwardly from said end of said tubular member and having at a location spaced outwardly from said end of said tubular member an upward projection, said recess being provided in an upper end of said upward projection.

23. An apparatus according to claim 22, wherein said support part has a further transversely extending recess in an upper surface thereof between said upward projection and said end of said tubular member.

* * * * *